United States Patent [19]

Lembens

[11] Patent Number: 4,936,213

[45] Date of Patent: Jun. 26, 1990

[54] INKING UNIT COVER AND STAMP INK CONTAINER FOR AN INKING SYSTEM

[75] Inventor: Helmut Lembens, Wiesbaden-Naurod, Fed. Rep. of Germany

[73] Assignee: Francotyp-Postalia GmbH, Berlin, Fed. Rep. of Germany

[21] Appl. No.: 311,418

[22] Filed: Feb. 13, 1989

Related U.S. Application Data

[63] Continuation of Ser. No. 126,885, Nov. 30, 1987, abandoned.

[30] Foreign Application Priority Data

Dec. 2, 1986 [DE] Fed. Rep. of Germany ..... 3641231

[51] Int. Cl.[5] ..... B41F 1/46

[52] U.S. Cl. ..... 101/348; 101/363; 101/364

[58] Field of Search ..... 101/363, 364, 366, 348; 401/134

[56] References Cited

U.S. PATENT DOCUMENTS

| | | | |
|---|---|---|---|
| 3,145,653 | 8/1964 | Lake | 101/364 |
| 3,318,238 | 5/1967 | Gottscho | 101/364 |
| 3,786,746 | 1/1974 | Roberts | 101/364 |
| 3,788,753 | 1/1974 | Stewart | 401/134 |
| 3,910,706 | 10/1975 | Del Bon | 401/134 |
| 3,973,699 | 8/1976 | Cook | 101/363 |
| 4,022,124 | 5/1977 | Knudsen | 101/348 |
| 4,155,304 | 5/1979 | Schweisser et al. | 101/366 |
| 4,277,791 | 7/1981 | Rosenstock et al. | 101/364 |
| 4,372,208 | 2/1983 | Legardinier | 101/366 |
| 4,455,938 | 6/1984 | London | 101/363 |
| 4,597,329 | 7/1986 | Lembens | 101/350 |
| 4,697,517 | 10/1987 | Fassman et al. | 101/348 |

FOREIGN PATENT DOCUMENTS

| | | | |
|---|---|---|---|
| 696233 | 9/1940 | Fed. Rep. of Germany | 101/364 |
| 2336440 | 7/1973 | Fed. Rep. of Germany | 101/364 |
| 2351500 | 5/1974 | Fed. Rep. of Germany | 101/364 |
| 3316558 | 3/1987 | Fed. Rep. of Germany | 101/350 |

OTHER PUBLICATIONS

Green et al., "Constant Pressure Head Ink Supply", IBM Tech Disclosure Bulletin, vol. 15, No. 9, p. 2898, 2-73.

*Primary Examiner*—Edgar S. Burr
*Assistant Examiner*—M. Patel
*Attorney, Agent, or Firm*—Herbert L. Lerner; Laurence A. Greenberg

[57] ABSTRACT

An inking system of postage and valuation stamping machines has an inking unit with an ink chamber and a portion covering the ink chamber. An inking unit cover has a stepped shape and a drip edge at a step thereof with a wedge-shaped cross section. The inking unit cover has a funnel disposed on the portion of the inking system covering the ink chamber for refilling the ink chamber with stamp ink. A stamp ink container is provided in the form of a cartridge. The funnel guides, retains and empties the cartridge.

12 Claims, 2 Drawing Sheets

INKING UNIT COVER AND STAMP INK CONTAINER FOR AN INKING SYSTEM

This application is a continuation, of application Ser. No. 126,885, filed Nov. 30, 1987, now abandoned.

Specification

The invention relates to an inking unit cover and a stamp ink container for an inking system of postage and valuation or price stamping machines.

Inking systems such as that according to German Patent No. DE-PS 33 16 558, conventionally include a form roller, an inking roller and an ink carrier roller which are operatively connected to one another and disposed in a housing together with a reservoir container into which the ink carrier roller dips, as well as a drive provided by a pressure drum of the postage or valuation or price stamping machine.

Such large-scale inking systems for high-speed postage printing machines must be supplied with correspondingly large quantities of ink. The ink reservoir in the machines must be refilled as soon as the ink drops below a certain level, which is monitored and indicated, for instance, by monitoring means of a circulation system. In all known postage printing machines, when the stamp ink needs refilling, the cover of the inking system must be removed and the ink is replenished from a supply container. A correspondingly refilling is necessary in smaller inking systems as well. Due to the continuous rotation of the ink carrier roller, ink also gets on the cover of the inking system, so that refilling by lifting the cover, especially when partial emptying of ink bottles is involved, can be a very dirty operation.

It is accordingly an object of the invention to provide an inking unit cover and stamp ink container for an inking system, which overcomes the hereinafore-mentioned disadvantages of the heretofore-known devices of this general type and which provides an ink refill device that is simple to manipulate and makes it unnecessary to open the inking system for refilling.

With the foregoing and other objects in view there is provided, in accordance with the invention, in an inking system of postage and valuation stamping machines having an inking unit with an ink chamber and a portion covering the ink chamber, the improvement comprising an inking unit cover having a stepped shape and a drip edge at a step thereof with a wedge-shaped cross section, the inking unit cover having a funnel disposed on the portion of the inking system covering the ink chamber for refilling the ink chamber with stamp ink, and a stamp ink container in the form of a cartridge, the funnel including means for guiding, retaining and opening the cartridge.

In accordance with another feature of the invention, the means for guiding, retaining and opening the cartridge are in the form of a screw connection between the cartridge and the funnel.

In accordance with a further feature of the invention, the means for guiding, retaining and opening the cartridge are in the form of a pusher rod of the funnel for emptying the cartridge and resilient elements in the funnel for retaining the funnel.

In accordance with an added feature of the invention, the cartridge is in the form of a hollow cylindrical body including a cylindrical discharge connection mounted on the hollow cylindrical body and a lid integral with the hollow cylindrical body for sealing the hollow cylindrical body.

In accordance with an additional feature of the invention, the screw connection includes a threaded stem inserted into an opening formed in the funnel and retained by ribs.

In accordance with yet another feature of the invention, the threaded stem is in the form of an obliquely cut-off hollow cylinder.

In accordance with yet a further feature of the invention, the discharge connection has an inner wall, the cartridge includes a disk disposed between the hollow cylindrical body and the discharge connection, and the disk has a periphery with a reduced thickness being integrally joined with and formed of the same material as the inner wall of the discharge connection.

In accordance with a concomitant feature of the invention, there are provided hollow cylindrical bodies attached to the cartridge for increasing the effective volume of the cartridge.

Other features which are considered as characteristic for the invention are set forth in the appended claims.

Although the invention is illustrated and described herein as embodied in an inking unit cover and stamp ink container for an inking system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
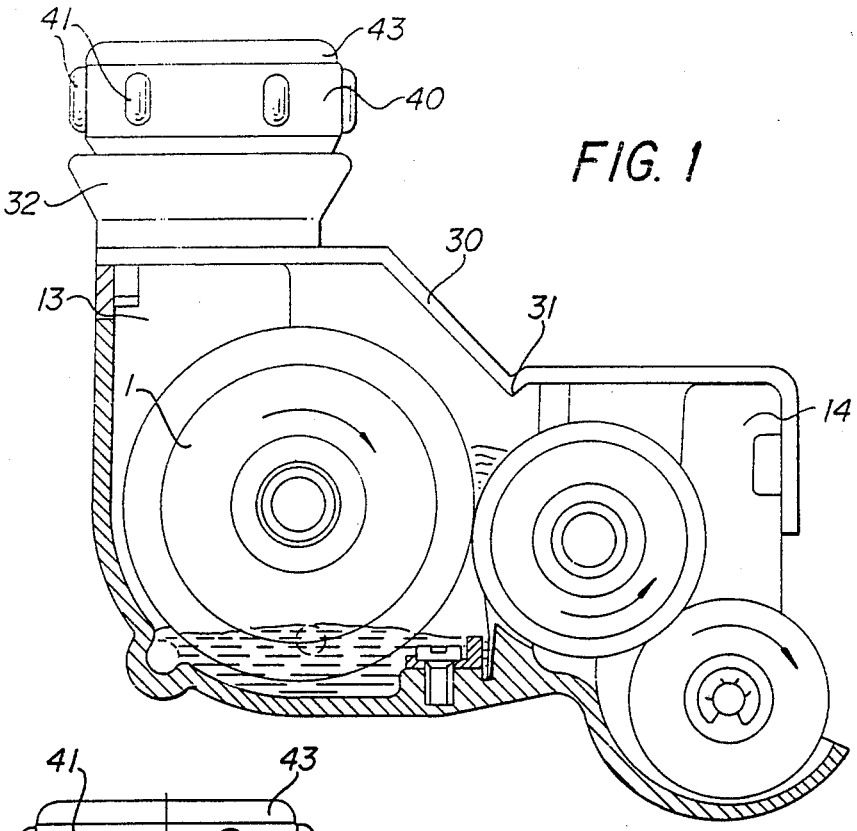
FIG. 1 is a partly cross-sectional view of an inking system with an inking unit cover.
Figure 2:
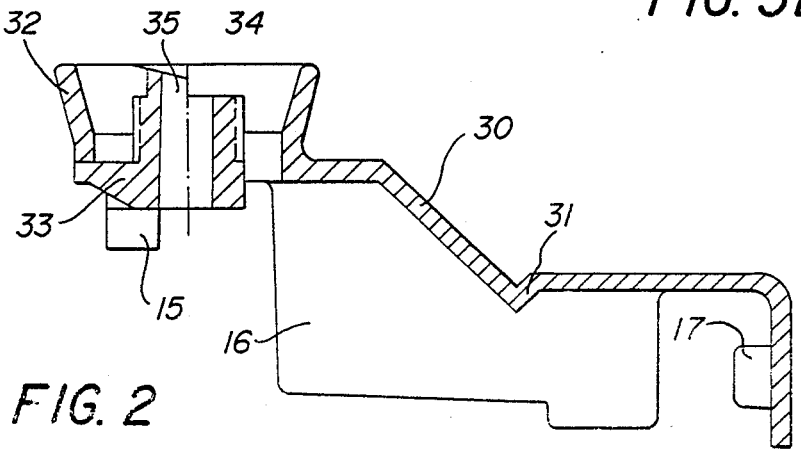
FIG. 2 is a cross-sectional view of the inking unit cover.

Referring now in detail to the figures of the drawings in which identical elements are identified by the same reference numerals and first, particularly, to FIGS. 1 and 2 thereof, there is seen an inking unit cover 30 which has been given a stepped shape for the purpose of optimal mutual demarcation of the various chambers of the inking system. Such a demarcation prevents spinning of the stamping ink into the next chamber at relatively high rotational speeds.

In order to increase rigidity and to provide a drip edge 31 for the stamp ink that has been spun upward, the inking unit cover 30 has a wedge-shaped cross section at the transition from an ink chamber 13 in which an ink carrier roller 1 is disposed to an overflow chamber 14 in which other rollers are disposed.

The portion of the inking unit cover 30 covering the ink chamber 13 has a funnel 32, which is integrally joined with and is made of the same material as the cover. A threaded stem 34 is inserted into the funnel opening and retained, for instance, by three ribs 33. The upper end of the threaded stem 34 is in the form of an obliquely cut-off hollow cylinder 35. Lateral clamping dogs 15 and guide surfaces 16, 17 are also provided for ensuring a snug fit of the inking unit cover on the inking system. These elements are only partly shown in FIG. 1, for the sake of clarity in the drawing.

Figure 3:
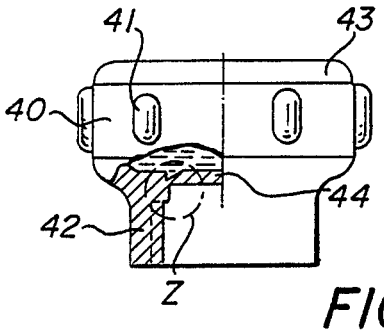
FIG. 3 is a partly broken-away side-elevational view of a cartridge as well as an enlarged view of a portion thereof.
Figure 3B:
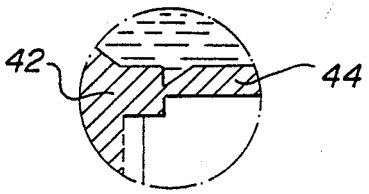
FIG. 3B is an enlarged view of the portion "Z" in FIG. 3.

The funnel 32 serves to guide, hold and open a cartridge 40 that is filled with stamp ink. As seen in FIG. 3 the cartridge 40 is a cylindrical hollow body which has knobs 41 on the periphery thereof, a cylindrical discharge connection 42 at one end and a lid 43 closing the other end thereof. The lid 43 completely seals the cartridge 40 by means of ultrasonic welding. A disk 44 having a reduced thickness at the periphery thereof is placed upstream of the discharge connection 42, which is provided with an internal thread. The disk 44 serves as a partition or seal and is made of the same material and integrally joined to the inner wall of the connection 42. In order to refill the inking system with stamp ink, the cartridge 40 is screwed onto the threaded stem 34 until it meets the discharge connection 42 at the ribs 33. As a result, the hollow cylinder 35 pushes open the disk 44 of the cartridge 40 and the stamp ink drains into the ink chamber 13 of the inking system.

The inking unit cover 30 and the cartridge 40 are made of plastic.

Figure 3A:
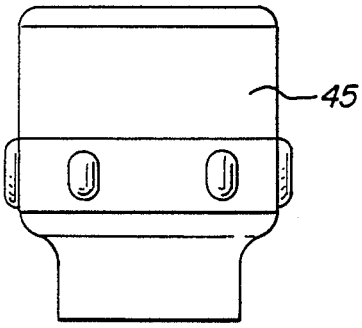
FIG. 3A is a side-elevational view of another embodiment of a cartridge.

The cartridge 40 can be made in various sizes for various capacities. In FIGS. 1–3, an embodiment is shown for a small refilling quantity of stamp ink. For larger quantities, the cartridge 40 can be enlarged in height, such as by replacing the lid 43 with a further, preferably cylindrical hollow body 45 of equal or larger volume that is integrally attached and made of the same material as shown in FIG. 3A.

Figure 2A:
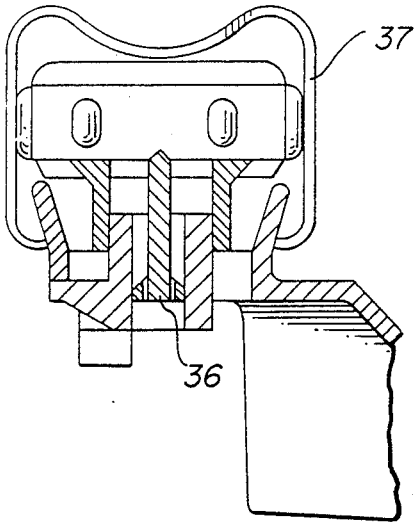
FIG. 2A is a fragmentary, cross-sectional view similar to FIG. 2 showing another embodiment of the inking unit cover.

Instead of the screw connection between the funnel 32 and the cartridge 40, a pusher rod 36 can also be used for opening the bottom of the cartridge 40 in the funnel 32. In such a case, cartridge 40 is retained in its position by a resilient element 37 shown in FIG. 2A.

I claim:

1. In an inking system of postage and valuation stamping machines having an inking unit, the improvement comprising an ink chamber, an overflow chamber separate from the ink chamber, a transition region disposed between the ink chamber and the overflow chamber, an inking unit cover having a portion covering the ink chamber from above, said inking unit cover having a stepped shape and a downwardly extending projection serving as a drip edge at the transition region, said inking unit cover having a funnel disposed on the portion of said inking unit cover covering the ink chamber from above for refilling the ink chamber with stamp ink, and a stamp ink container in the form of a cartridge, said funnel including means for guiding, retaining and opening said cartridge upon placement of said cartridge on said funnel.

2. Inking system according to claim 1, wherein said means for guiding, retaining and opening said cartridge includes a screw connection between said cartridge and said funnel.

3. Inking system according to claim 1, wherein said means for guiding, retaining and opening said cartridge a pusher rod in said funnel for opening said cartridge and resilient elements in said funnel for retaining said cartridge.

4. Inking system according to claim 1, wherein said cartridge is in the form of a hollow cylindrical body including a cylindrical discharge connection mounted on said hollow cylindrical body and a lid integral with said hollow cylindrical body for sealing said hollow cylindrical body.

5. Inking system according to claim 1, wherein said cartridge is in the form of a hollow cylindrical body including a cylindrical discharge connection mounted on said hollow cylindrical body and a lid ultrasonically welded to said hollow cylindrical body for sealing said hollow cylindrical body.

6. Inking system according to claim 2, wherein said screw connection includes a threaded stem inserted into an opening formed in said funnel and retained by ribs.

7. Inking system according to claim 6, wherein said threaded stem is in the form of an obliquely cut-off hollow cylinder.

8. Inking system according to claim 4, wherein said discharge connection has an inner wall, said cartridge includes a disk disposed between said hollow cylindrical body and said discharge connection, and said disk has a periphery with a reduced thickness being integrally joined with and formed of the same material as said inner wall of said discharge connection.

9. Inking system according to claim 5, wherein said discharge connection has an inner wall, said cartridge includes a disk disposed between said hollow cylindrical body and said discharge connection, and said disk has a periphery with a reduced thickness being integrally joined with and formed of the same material as said inner wall of said discharge connection.

10. Inking system according to claim 1, including hollow cylindrical bodies attached to said cartridge for increasing the effective volume of said cartridge.

11. Inking system according to claim 1, wherein said drip edge has a wedge-shaped cross section.

12. Inking system according to claim 1, wherein said inking unit cover has an upper portion above the ink chamber and a lower portion above the overflow chamber, said drip edge being disposed between said upper and lower portions.

* * * * *